United States Patent [19]

Daubendiek et al.

[11] 4,414,310

[45] Nov. 8, 1983

[54] PROCESS FOR THE PREPARATION OF HIGH ASPECT RATIO SILVER BROMOIODIDE EMULSIONS

[75] Inventors: Richard L. Daubendiek, Rochester; Ronald W. Strong, Webster, both of N.Y.

[73] Assignee: Eastman Kodak Company, Rochester, N.Y.

[21] Appl. No.: 429,587

[22] Filed: Sep. 30, 1982

Related U.S. Application Data

[63] Continuation-in-part of Ser. No. 320,906, Nov. 12, 1981, abandoned.

[51] Int. Cl.[3] ..... G03C 1/02

[52] U.S. Cl. ..... 430/567; 430/569

[58] Field of Search ..... 430/567, 569

[56] References Cited

U.S. PATENT DOCUMENTS

| | | | |
|---|---|---|---|
| 4,063,951 | 12/1977 | Bogg | 430/567 |
| 4,067,739 | 1/1978 | Lewis | 430/567 |
| 4,150,994 | 4/1979 | Maternaghan | 430/567 |
| 4,184,877 | 1/1980 | Maternaghan | 430/567 |
| 4,184,878 | 1/1980 | Maternaghan | 430/567 |

FOREIGN PATENT DOCUMENTS

| | | |
|---|---|---|
| 2905655 | 2/1978 | Fed. Rep. of Germany . |
| 55-142329 | 11/1980 | Japan . |
| 1570581 | 7/1980 | United Kingdom . |

OTHER PUBLICATIONS deCugnac and Chateau, "Evolution of the Morphology of Silver Bromide Crystals During Physical Ripening", *Science et Industries Photographiques,* vol. 33, No. 2 (1962) pp. 121–125.

Duffin, *Photographic Emulsion Chemistry,* Focal Press, 1966 pp. 66–72.

Trivelli and Smith, "The Effect of Silver Iodide Upon the Structure of Bromo-Iodide Precipitation Series", *The Photographic Journal,* vol. LXXX, Jul. 1940, pp. 285–288.

*Primary Examiner*—Mary F. Downey

*Attorney, Agent, or Firm*—Carl O. Thomas

[57] ABSTRACT

A process is disclosed of preparing radiation-sensitive tabular grain silver bromoiodide emulsions. This is achieved by providing in a reaction vessel an emulsion comprising a dispersing medium and high iodide silver halide grains. The mean diameter of the silver halide grains is less than 0.1 micron, and the concentration of iodide is less than $10^{-2}$ mole per liter of the emulsion. Upon concurrently running into the reaction vessel silver and bromide, a high aspect ratio tabular grain silver bromoiodide emulsion is obtained.

10 Claims, 3 Drawing Figures

PROCESS FOR THE PREPARATION OF HIGH ASPECT RATIO SILVER BROMOIODIDE EMULSIONS

This is a continuation-in-part of copending, commonly assigned U.S. Ser. No. 320,906, filed Nov. 12, 1981, now abandoned.

FIELD OF THE INVENTION

This invention relates to processes for the preparation of radiation-sensitive silver bromoiodide emulsions useful in photographic elements.

BACKGROUND OF THE INVENTION

Radiation-sensitive emulsions employed in photography are comprised of a dispersing medium, typically gelatin, containing embedded microcrystals—known as grains—of radiation-sensitive silver halide. Seldom are emulsions other than silver bromoiodide employed in camera speed photographic elements. Illingsworth U.S. Pat. No. 3,320,069 discloses gelatino-silver bromoiodide emulsions in which the iodide preferably comprises from 1 to 10 mole percent. Silver bromoiodide emulsions do not consist of some crystals of silver bromide and others of silver iodide. Rather, all of the crystals contain both bromide and iodide. Although it is possible to introduce silver iodide up to its solubility limit in silver bromide—that is, up to about 40 mole percent iodide, depending upon the temperature of grain formation, much lower iodide concentrations are usually employed. Except for specialized applications, silver bromoiodide emulsions seldom employ more than about 20 mole percent iodide. Even very small amounts of iodide, as low as 0.05 mole percent, can be beneficial. (Except as otherwise indicated, all references to halide percentages are based on silver present in the corresponding emulsion, grain, or grain region being discussed; e.g., a grain consisting of silver bromoiodide containing 40 mole percent iodide also contains 60 mole percent bromide.)

A great variety of regular and irregular grain shapes have been observed in silver bromoiodide photographic emulsions. Frequently the grains are cubic or octahedral in shape. Grain edges may exhibit rounding due to ripening effects, and in the presence of strong ripening agents, such as ammonia, the grains may even be spherical. Rods and tabular grains in varied proportions have been frequently observed mixed in among other grain shapes, particularly where the pAg (the negative logarithm of silver ion concentration) of the emulsions has been varied during precipitation, as occurs, for example in single jet precipitation.

Tabular silver bromide grains have been extensively studied, often in macro-sizes having no photographic utility. Tabular grains are herein defined as those having two substantially parallel crystal faces, each of which is substantially larger than any other single crystal face of the grain. The term "substantially parallel" as used herein is intended to include surfaces that appear parallel on direct or indirect visual inspection at 10,000 times magnification. The aspect ratio—that is, the ratio of diameter to thickness—of tabular grains is substantially greater than 1:1. High aspect ratio tabular grain silver bromide emulsions were reported by de Cugnac and Chateau, "Evolution of the Morphology of Silver Bromide Crystals During Physical Ripening", *Science et Industries Photographiques*, Vol. 33, No. 2 (1962), pp. 121–125.

Although tabular grain silver bromoiodide emulsions are known in the art, none exhibit a high average aspect ratio. A discussion of tabular silver bromoiodide grains appear in Duffin, *Photographic Emulsion Chemistry*, Focal Press, 1966, pp. 66–72, and Trivelli and Smith, "The Effect of Silver Iodide Upon the Structure of Bromo-Iodide Precipitation Series", *The Photographic Journal*, Vol. LXXX, July 1940, pp. 285–288. Trivelli and Smith observed a pronounced reduction in both grain size and aspect ratio with the introduction of iodide.

Bogg, Lewis, and Maternaghan have recently published procedures for preparing emulsions in which a major proportion of the silver halide is present in the form of tabular grains. Bogg U.S. Pat. No. 4,063,951 teaches forming silver halide crystals of tabular habit bounced by {100} cubic faces and having an aspect ratio (based on edge length) of from 1.5 to 7:1. The tabular grains exhibit square and rectangular major surfaces characteristic of {100} crystal faces. Lewis U.S. Pat. No. 4,067,739 teaches the preparation of silver halide emulsions wherein most of the crystals are of the twinned octahedral type by forming seed crystals, causing the seed crystals to increase in size by Ostwald ripening in the presence of a silver halide solvent, and completing grain growth without renucleation or Ostwald ripening while controlling pBr (the negative logarithm of bromide ion concentration). Maternaghan U.S. Pat. Nos. 4,150,994, 4,184,877, and 4,184,878, U.K. Pat. No. 1,570,581, and German OLS publication Nos. 2,905,655 and 2,921,077 teach the formation of silver halide grains of flat twinned octahedral configuration by employing seed crystals the halide of which is at least 90 mole percent iodide. Lewis and Maternaghan report increased covering power. Maternaghan states that the emulsions are useful in camera films, both black-and-white and color. Bogg specifically reports an upper limit on aspect ratios to 7:1, and, from the very low aspect ratios obtained by the examples, the 7:1 aspect ratio appears unrealistically high. It appears from repeating examples and viewing the photomicrographs published that the aspect ratios realized by Lewis and Maternaghan were also less than 7:1. Japanese patent Kokai No. 142,329, published Nov. 6, 1980, appears to be essentially cumulative with Maternaghan, but is not restricted to the use of silver iodide seed grains.

Wilgus and Haefner in U.S. Ser. No. 429,420, filed concurrently herewith and commonly assigned, titled High Aspect Ratio Silver Bromoiodide Emulsions and Processes for Their Preparation which is a continuation-in-part of U.S. Ser. No. 320,905, filed Nov. 12, 1981, now abandoned, were the first to prepare high aspect ratio tubular grain silver bromoiodide emulsions. The present invention represents an alternative process of preparing such emulsions. According to the process of Wilgus and Haefner the pBr (the negative logarithm of bromide ion concentration) of the dispersing medium within the reaction vessel is adjusted to a level of from 0.6 to 1.6 with the reaction vessel being initially substantially free of iodide salts. To form high aspect ratio tabular silver bromoiodide grains silver, bromide, and iodide salts are concurrently added to the reaction vessel while maintaining the pBr of the reaction vessel above 0.6.

Kofron et al U.S. Ser. No. 429,407, filed concurrently herewith and commonly assigned, titled Sensitized High Aspect Ratio Silver Halide Emulsions and Photographic Elements, which is a continuation-in-part of U.S. Ser. No. 320,904, filed Nov. 12, 1981, now abandoned, more fully discussed below, discloses chemically and spectrally sensitized high aspect ratio tabular grain silver halide emulsions and photographic elements incorporating these emulsions.

SUMMARY OF THE INVENTION

In one aspect the invention is directed to an improvement in a process of preparing a radiation-sensitive tabular grain silver bromoiodide emulsion wherein silver and bromide salts are concurrently introduced into a reaction vessel containing an emulsion comprising a dispersing medium and high iodide silver halide grains. The improvement comprises limiting in the reaction vessel prior to concurrent introduction of silver and bromide salts (1) the mean diameter of the high iodide silver halide grains to less than 0.1 micron and (2) the concentration of iodide to less than $10^{-2}$ mole per liter.

Silver bromoiodide grains are thereby produced within the dispersing medium contained within the reaction vessel. The silver bromoiodide grains having a thickness of less than 0.3 micron and a diameter of at least 0.6 micron exhibit an average aspect ratio of grater than 8:1 and account for at least 50 percent of the total projected area of the silver bromoiodide grains.

The present invention can be viewed as an improvement on the processes of Maternaghan, cited above. Specifically, the present invention provides a process whereby high aspect ratio tabular grain silver bromoiodide emulsions can be prepared by placing in the reaction vessel high iodide silver halide grains. By limiting both the size and the concentration of these high iodide silver halide grains high aspect ratio tabular grain emulsions are achieved whereas following the teachings of Maternaghan only emulsions of substantially lower aspect ratios have been obtained.

DESCRIPTION OF PREFERRED EMBODIMENTS

Figure 1:
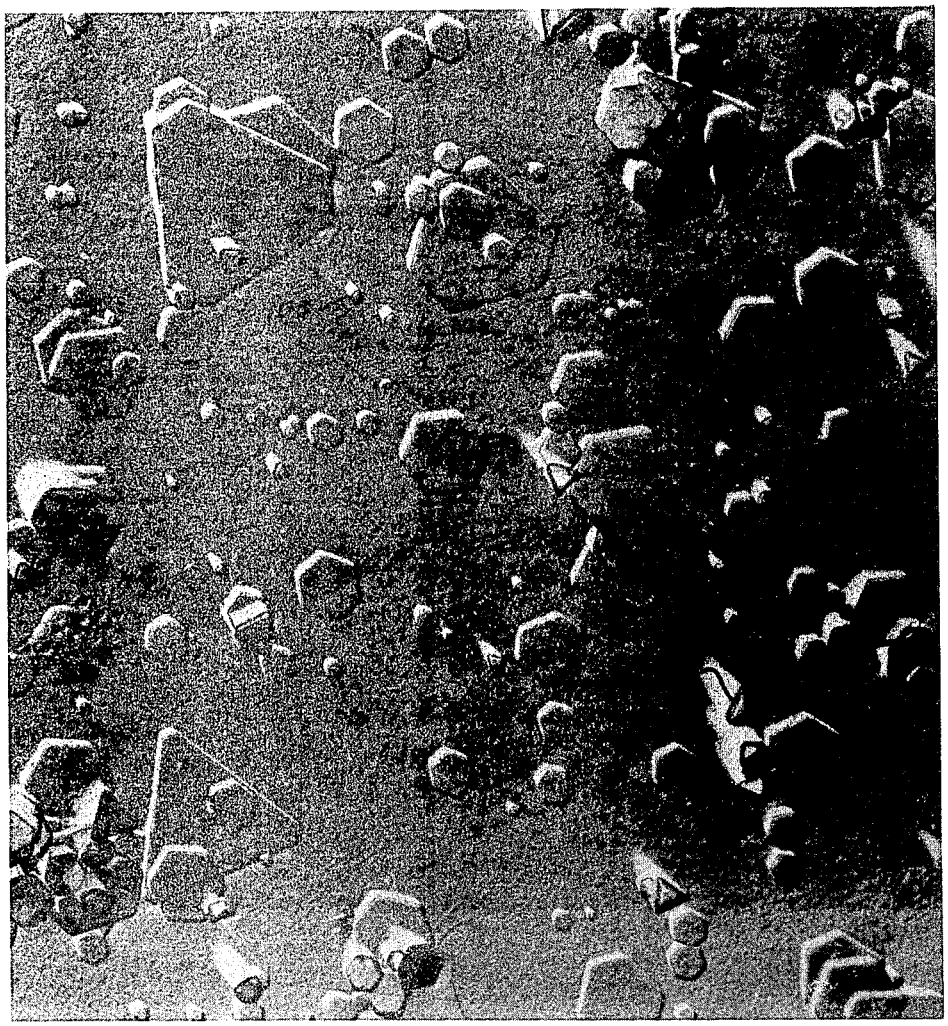
FIGS. 1, 2, and 3 are photomicrographs of silver halide emulsions, FIGS. 1 and 3 illustrating the invention and FIG. 2 illustrating a control emulsion.

This invention relates to processes for the preparation of high aspect ratio tabular grain silver bromoiodide emulsions useful in photographic elements. As applied to the silver bromoiodide emulsions produced by the present invention the term "high aspect ratio" is herein defined as requiring that the silver bromoiodide grains having a thickness of less than 0.3 micron and a diameter of at least 0.6 micron have an average aspect ratio of greater than 8:1 and account for at least 50 percent of the total projected area of the silver bromoiodide grains. (The term "high aspect ratio" is analogously applied to silver halide emulsions of differing halide composition.)

The preferred high aspect ratio tabular grain silver bromoiodide emulsions produced by the present invention are those wherein the silver bromoiodide grains having a thickness of less than 0.3 micron (optimally less than 0.2 micron) and a diameter of at least 0.6 micron have an average aspect ratio of at least 12:1 and optimally at least 20:1. Extremely high average aspect ratios (50:1 or even 100:1 or more) can be obtained. In a preferred form of the invention these silver bromoiodide grains account for at least 70 percent and optimally at least 90 percent of the total projected area of the silver bromoiodide grains. The maximum average grain diameters of high aspect ratio tabular grain silver bromoiodide emulsions produced according to this invention are in all instances less than 30 microns, preferably less than 15 microns, and optimally less than 10 microns.

It is appreciated that the thinner the tabular grains accounting for a given percentage of the projected area, the higher the average aspect ratio of the emulsion. Typically the tabular grains have an average thickness of at least 0.03 micron, although even thinner tabular grains can in principle be employed. It is recognized that the tabular grains can be increased in thickness to satisfy specialized applications. For example, Jones and Hill U.S. Ser. No. 430,092, filed concurrently herewith and commonly assigned, titled Photographic Image Transfer Film Unit, which is a continuation-in-part of U.S. Ser. No. 320,911, filed Nov. 12, 1981, now abandoned, contemplates the use of tabular grains having average thicknesses up to 0.5 micron. (For such an application all references to 0.3 micron in reference to aspect ratio determinations should be adjusted to 0.5 micron.) However, to achieve high aspect ratios without unduly increasing grain diameters, it is normally contemplated that the tabular grains of the emulsions of this invention will have an average thickness of less than 0.3 micron.

The grain characteristics described above of the silver bromoiodide emulsions produced by the process of this invention can be readily ascertained by procedures well known to those skilled in the art. As employed herein the term "aspect ratio" refers to the ratio of the diameter of the grain to its thickness. The "diameter" of the grain is in turn defined as the diameter of a circle having an area equal to the projected area of the grain as viewed in a photomicrograph of an emulsion sample. From shadowed electron micrographs of emulsion samples it is possible to determine the thickness and diameter of each grain and to identify those tabular grains having a thickness of less than 0.3 micron and a diameter of at least 0.6 micron. From this the aspect ratio of each such tabular grain can be calculated, and the aspect ratios of all the tabular grains in the sample meeting the less than 0.3 micron thickness and at least 0.6 micron diameter criteria can be averaged to obtain their average aspect ratio. By this definition the average aspect ratio is the average of individual tabular grain aspect ratios. In practice it is usually simpler to obtain an average thickness and an average diameter of the tabular grains having a thickness of less than 0.3 micron and a diameter of at least 0.6 micron and to calculate the average aspect ratio as the ratio of these two averages. Whether the averaged individual aspect ratios or the averages of thickness and diameter are used to determine the average aspect ratio, within the tolerances of grain measurements contemplated, the average aspect ratios obtained do not significantly differ. The projected areas of the tabular silver bromoiodide grains meeting the thickness and diameter criteria can be summed, the projected areas of the remaining silver bromoiodide grains in the photomicrograph can be summed separately, and from the two sums the percentage of the total projected area of the silver bromoiodide grains provided by the grains meeting the thickness and diameter critera can be calculated.

In the above determinations a reference tabular grain thickness of less than 0.3 micron was chosen to distinguish the uniquely thin tabular grains herein contemplated from thicker tabular grains which provide inferior photographic properties. A reference grain diameter of 0.6 micron was chosen, since at lower diameters it is not always possible to distinguish tabular and nontabular grains in micrographs. The term "projected area" is used in the same sense as the terms "projection area" and "projective area" commonly employed in the art; see, for example, James and Higgins, *Fundamentals of Photographic Theory*, Morgan and Morgan, New York, p. 15.

FIG. 1 is an exemplary photomicrograph of an emulsion prepared by the process of the present invention chosen to illustrate the variant grains that can be present. Grain 101 illustrates a tabular grain that satisfies the thickness and diameter criteria set forth above. It is apparent that the vast majority of the grains present in FIG. 1 are tabular grains which satisfy the thickness and diameter critera. These grains exhibit an average aspect ratio of 19.5:1. Also present in the photomicrograph are a few grains which do not satisfy the thickness and diameter critera. The grain 103, for example, illustraates a nontabular grain. It is of a thickness greater than 0.3 micron. The grain 105 illustrates a fine grain present that does not satisfy the diameter criterion. Depending upon the conditions chosen for emulsion preparation, more specifically discussed below, in addition to the desired tabular silver bromoiodide grains satisfying the thickness and diameter criteria secondary grain populations of largely nontabular grains, fine grains, or thick tabular grains can be present. Occasionally other nontabular grains, such as rods, can be present. While it is generally preferred to maximize the number of tabular grains satisfying the thickness and diameter criteria, the presence of secondary grain populations can be tolerated, provided the emulsions remain of high aspect ratio, as defined above.

The process of the present invention can be identical to the process of preparing tabular grain silver bromoiodide emulsions disclosed by Maternaghan U.S. Pat. Nos. 4,150,994, 4,184,877, and 4,184,878, U.K. Pat. No. 1,570,581, and German OLS Nos. 2,905,655 and 2,921,077, here incorporated by reference, except for differing in the concentration of the high iodide silver halide grains present in the reaction vessel prior to concurrent silver and bromide salt introductions. However, it is desirable not to employ the Ostwald ripening step using ammonia as a silver halide solvent as taught by Maternaghan, since the presence of ammonia tends to form thicker crystals thereby resulting in a lower average aspect ratio.

Specifically, the achievement of high aspect ratio tabular grain silver bromoiodide emulsions by the process of this invention is recognized to depend on limiting the initial concentration of silver iodide in the reaction vessel prior to concurrent silver and bromide salt introductions to less than $10^{-2}$ mole per liter of liquid (dispersing medium) present in the reaction vessel. This is to be contrasted with Maternaghan's teaching that the silver iodide content should be in the range of from $5\times10^{-2}$ to 2.0 moles per liter. At a minimum, Maternaghan teaches to employ more than five times the initial silver iodide concentration used in the practice of this process. The adverse effect of even the minimum silver iodide concentration taught by Maternaghan is dramatically demonstrated below in conjunction with the Examples.

The minimum concentration of silver iodide present in the reaction vessel in the practice of this process will vary, depending upon the specific conditions under which silver halide precipitation is contemplated. In order to provide silver iodide seed grains it is essential that the silver iodide concentration initially be above the solubility limit of silver iodide in the dispersing medium. This level depends upon both the temperature and the exact composition of the dispersing medium. A minimum silver iodide concentration of at least $10^{-5}$ mole per liter of dispersing medium in the reaction vessel is generally useful and is preferred. It is preferred that the silver iodide concentration in the reaction vessel be in the range of from $10^{-3}$ to $10^{-5}$ mole per liter of dispersing medium present in the reaction vessel prior to concurrent silver and bromide salt introductions.

The present process is further distinguishable from the process of Maternaghan in terms of the size of the high iodide silver halide grains initially present in the reaction vessel prior to concurrent introduction of silver and bromide salts. Whereas Maternaghan teaches the use of high iodide silver halide grains of from 0.05 to 0.5 micron in diameter, the present process employs high iodide silver halide grains initially in the reaction vessel having an average diameter of less than 0.1 micron and preferably less than 0.05 micron. The minimum size of the high iodide silver halide grains can be widely varied below the levels above while still achieving the advantages of this invention. The minimum high iodide silver halide grain sizes capable of remaining as grains rather than dissolving in the dispersing medium can be employed. It is generally contemplated to employ high iodide silver halide grains having an average minimum diameter in the range of at least 0.015 micron, preferably at least 0.02 micron.

With the improvement noted above, the remainder of the present process can be identical to that of Maternaghan. Specifically, the invention can comprise (a) either placing or forming a dispersion containing high iodide silver halide grains of hexagonal pyramidal or bipyramidal lattice form and a dispersing medium in a conventional silver halide precipitation apparatus, (b) mixing in the dispersing medium containing the high iodide silver halide grains an aqueous solution of a silver salt, a bromide salt, and, optionally, an iodide salt, (c) optionally adding a silver halide solvent to the dispersing medium and so causing the growth of tabular silver bromoiodide grains, (d) continuing addition of silver and bromide salt solutions to increase the size of the tabular silver bromoiodide grains, and (e) optionally removing the water-soluble salts formed. After precipitation and, optionally, washing, the emulsions can be further processed for use in photographic elements following conventional techniques, such as chemical sensitization, spectral sensitization, and the incorporation of modifying addenda, if any.

Although the remainder of the process can be identical to that of Maternaghan, additional variations are specifically contemplated. For example, instead of completing step (a) prior to performing step (b), it is specifically contemplated to overlap these steps. For example, the iodide salt can be placed in the reaction vessel and silver and bromide salts thereafter concurrently introduced. Since silver iodide exhibits a much lower solubility than silver bromide, high iodide silver halide grains will first form in the reaction vessel. Once the iodide salt in the reaction vessel is substantially depleted, the process proceeds similarly as if the high iodide silver halide grains had been preformed prior to bromide salt introduction. In this approach it is, of course, necessary to limit the iodide salt initially in the reaction vessel so that the maximum silver iodide concentration and grain size described above are not exceeded.

The high iodide silver halide grains initially introduced or formed in the reaction vessel can consist essentially of silver iodide or can contain in combination other silver halides—i.e., silver chloride and/or bromide. Maximum permissible amounts of other silver halides is determined by the amount of the other silver halide that can be introduced into the lattice configuration of the silver iodide without causing a separate significant silver halide phase to result. A hexagonal pyramidal or bipyramidal lattice configuration is typical, but not essential to the practice of the invention. Generally silver chloride and/or bromide are limited to about 10 mole percent of the silver halide present. In other words, the high iodide silver halide grains preferably contain at least 90 mole percent iodide.

In a specifically preferred process of practicing the present invention, into a conventional reaction vessel for silver halide precipitation equipped with an efficient stirring mechanism is introduced a dispersing medium. Typically the dispersing medium initially introduced into the reaction vessel is at least about 10 percent, preferably 20 to 80 percent, by weight, based on total weight of the dispersing medium present in the silver bromoiodide emulsion at the conclusion of grain precipitation. Since dispersing medium can be removed from the reaction vessel by ultrafiltration during silver bromoiodide grain precipitation, as taught by Mignot U.S. Pat. No. 4,334,012 here incorporated by reference, it is appreciated that the volume of dispersing medium initially present in the reaction vessel can equal or even exceed the volume of the silver bromoiodide emulsion present in the reaction vessel at the conclusion of grain precipitation. The dispersing medium initially introduced into the reaction vessel is preferably water or a dispersion of peptizer in water, optionally containing other ingredients, such as one or more silver halide ripening agents and/or metal dopants, more specifically described below. Where a peptizer is initially present, it is preferably employed in a concentration of at least 10 percent, most preferably at least 20 percent, of the total peptizer present at the completion of silver bromoiodide precipitation. Additional dispersing medium is added to the reaction vessel with the silver and halide salts and can also be introduced through a separate jet. It is common practice to adjust the proportion of dispersing medium, particularly to increase the proportion of peptizer, after the completion of the salt introductions.

The formation of high aspect ratio tabular grain silver bromoiodide emulsions can be viewed as being comprised of two distinct phases: (a) first, a nucleation phase in which tabular grain nuclei are formed and (b) second, a growth phase in which the tabular grain nuclei are grown to the desired grain size. The nucleation phase is itself made up of two distinct parts. In the first instance high iodide silver halide grains are formed or introduced into the reaction vessel. Thereafter, as silver and bromide salts are introduced, it is believed that separate silver bromide grain nuclei are formed by epitaxial growth onto the high iodide silver halide grains and that silver iodide migrates from the high iodide silver halide grains and is incorporated into the silver bromide crystal lattice as precipitation proceeds.

Although it is necessary to limit the concentration of silver iodide present during the nucleation phase of precipitation in order to obtain high aspect ratio silver bromoiodide tabular grains, once precipitation has proceeded to the growth phase, iodide can be incorporated into the tabular silver bromoiodide grains in any concentration up to the solubility limit of silver iodide in silver bromide under the conditions of precipitation. Iodide can be introduced by any conventional technique during the growth stage—e.g., as a salt solution containing both bromide and iodide, through a separate jet, or by introducing small (preferably less than 0.10 micron in diameter) silver iodide grains. Thus, it is specifically contemplated to prepare by the practice of the present process high aspect ratio tabular silver bromoiodide grains containing up to 40 mole percent iodide, with any lower iodide concentration down to the minimum iodide concentrations necessary to perform nucleation according to the present invention being specifically contemplated. Minimum iodide concentrations capable of imparting useful photographic effects (e.g., as low as 0.05 mole percent iodide) are specifically contemplated. Generally iodide concentrations of from about 0.1 to 20 mole percent, optimally 1 to 15 mole percent are preferred for most photographic applications requiring camera speed.

The dispersing medium introduced into the reaction vessel can initially contain high iodide silver halide grains, in which case the dispersing medium and the grains together form an emulsion, or the dispersing medium can contain a soluble iodide salt, such as an alkali or alkaline earth metal iodide dissolved therein, so that high iodide silver halide grains are formed in the dispersing medium upon concurrent introduction of silver and bromide salts. In a preferred form of the invention silver and iodide salts are concurrently run into the dispersing medium to form a high iodide silver halide emulsion by a double-jet precipitation technique. Such techniques are well known in the art, as illustrated by Maternaghan, cited above, and Maskasky U.S. Pat. Nos. 4,094,684 and 4,142,900, here incorporated by reference.

During double-jet precipitation step (b) silver, bromide, and, optionally, iodide salts are added to the reaction vessel by techniques well known in the precipitation of silver bromoiodide grains. Typically an aqueous silver salt solution of a soluble silver salt, such as silver nitrate, is introduced into the reaction vessel concurrently with the introduction of the bromide and iodide salts. The bromide and iodide salts are also typically introduced as aqueous salt solutions, such as aqueous solutions of one or more soluble ammonium, alkali metal (e.g., sodium or potassium), or alkaline earth metal (e.g., magnesium or calcium) halide salts. The soluble silver salt is introduced into the reaction vessel separately from the bromide and iodide salts. The iodide and bromide salts are added to the reaction vessel separately or as a mixture. The pBr of the reaction vessel is maintained at or above 0.6, preferably in the range of from about 0.6 to 2.2, most preferably from about 0.8 to about 1.6 during the concurrent introduction of silver and bromide salts. (As herein employed, pBr is defined as the negative logarithm of bromide ion concentration. pH, pI, and pAg are similarly defined for hydrogen, iodide, and silver ion concentrations, respectively.)

Although the foregoing precipitation descriptions are directed to the preparation of silver bromoiodide emulsions which are substantially or entirely devoid of chloride, it is specifically contemplated that chloride can comprise a minor proportion of the total halide present in the high aspect ratio tabular grain emulsions prepared by the present invention. Wey and Wilgus U.S. Ser. No. 431,854, filed concurrently herewith and commonly assigned, titled Novel Silver chlorobromide Emulsions and Processes for Their Preparation, which is a continuation-in-part of U.S. Ser. No. 320,899, filed Nov. 12, 1981, now abandoned, both of which are here incorporated by reference, discloses tabular grain emulsions wherein the silver halide grains contain silver chloride and silver bromide in at least annular grain regions and preferably throughout. The tabular grain regions containing silver chloride and bromide are formed by maintaining a molar ratio of chloride and bromide ions of from 1.6 to about 260:1 and the total concentration of halide ions in the reaction vessel in the range of from 0.10 to 0.90 normal during introduction of silver, chloride, bromide, and, optionally, iodide salts into the reaction vessel. The molar ratio of chloride to bromide in the tabular grains can range from 1:99 to 2:3.

As an alternative to the introduction of silver and halide salts as aqueous solutions, it is specifically contemplated to introduce the silver and halide salts in the form of fine silver halide grains suspended in dispersing medium. The grains are sized so that they are readily Ostwald ripened onto larger grain nuclei once introduced into the reaction vessel. The maximum useful grain sizes will depend on the specific conditions within the reaction vessel, such as temperature and the presence of solubilizing and ripening agents. Silver bromide, silver iodide, silver chloride, silver bromoiodide, and/or silver chlorobromoiodide grains can be introduced. The silver halide grains are preferably very fine—e.g., less than 0.1 micron in mean diameter.

Subject to the requirements set forth above, the concentrations and rates of silver and halide salt introductions can take any convenient conventional form. The silver and halide salts are preferably introduced in concentrations of from 0.1 to 5 moles per liter, although broader conventional concentration ranges, such as from 0.01 mole per liter to saturation, for example, are contemplated. Specifically preferred precipitation techniques are those which achieve shortened precipitation times by increasing the rate of silver and halide salt introduction during the run. The rate of silver and halide salt introduction can be increased either by increasing the rate at which the dispersing medium and the silver and halide salts are introduced or by increasing the concentrations of the silver and halide salts within the dispersing medium being introduced. It is specifically preferred to increase the rate of silver and halide salt introduction, but to maintain the rate of introduction below the threshold level at which the formation of new grain nuclei is favored—i.e., to avoid renucleation, as taught by Irie U.S. Pat. No. 3,650,757, Kurz U.S. Pat. No. 3,672,900, Saito U.S. Pat. No. 4,242,445, Wilgus German OLS No. 2,107,118, Teitscheid et al European Patent Application No. 80102242, and Wey "Growth Mechanism of AgBr Crystals in Gelatin Solution", *Photographic Science and Engineering,* Vol. 21, No. 1, January/February 1977, p. 14, et. seq. By avoiding the formation of additional grain nuclei after passing into the growth stage of precipitation, relatively monodispersed tabular silver bromoiodide grain populations can be obtained. Emulsions having coefficients of variation of less than about 30 percent can be prepared employing the process of the present invention. (As employed herein the coefficient of variation is defined as 100 times the standard deviation of the grain diameter divided by the average grain diameter). By intentionaly favoring renucleation during the growth stage of precipitation, it is, of course, possible to produce polydispersed emusions of substantially higher coefficients of variation.

The relative proportion of iodide and bromide salts introduced into the reaction vessel during precipitation can be maintained in a fixed ratio to form a substantially uniform iodide profile in the tabular silver bromoiodide grains or varied to achieve differing photographic effects. Solberg et al U.S. Ser. No. 413,013, concurrently filed and commonly assigned, titled Radiation-Sensitive Silver Bromoiodide Emulsions, Photographic Elements, and Processes For Their Use, which is a continuation-in-part of U.S. Ser. No. 320,909, filed Nov. 12, 1981, now abandoned, has recognized specific photographic advantages to result from increasing the proportion of iodide in annular regions of high aspect ratio tabular grain silver bromoiodide emulsions as compared to central regions of the tabular grains. Solberg et al teaches average iodide concentrations in the central regions of the tabular grains of from 0 to 5 mole percent, with at least one mole percent higher average iodide concentrations in the laterally surrounding annular region up to the solubility limit of silver iodide in silver bromides, preferably up to about 20 mole percent and optimally about 15 mole percent. Emulsions can be prepared by the process of the present invention satisfying iodide distribution requirements of Solberg et al. Both Solberg et al patent applications are here incorporated by reference. In a variant form of the present invention it is specifically contemplated to terminate halide salt addition to the reaction vessel prior to the termination of silver salt addition to that bromide ion in solution reacts with the silver salt. This results in silver bromide being formed on the tabular silver bromoiodide grains. Thus, it is apparent that the tabular silver bromoiodide grains of the present process can exhibit substantially uniform or graded iodide concentration profiles and that the gradation can be controlled, as desired, to favor high iodide concentrations internally or at or near the surfaces of the tabular silver bromoiodide grains.

Modifying compounds can be present during silver bromoiodide precipitation. Such compounds can be initially in the reaction vessel or can be added along with one or more of the salts according to conventional procedures. Modifying compounds, such as compounds of copper, thallium, lead, bismuth, cadmium, zinc, middle chalcogens (i.e., sulfur, selenium and tellurium), gold, and Group VIII noble metals, can be present during silver halide precipitation, as illustrated by Arnold et al U.S. Pat. No. 1,195,432, Hochstetter U.S. Pat. No. 1,951,933, Trivelli et al U.S. Pat. No. 2,448,060, Overman U.S. Pat. No. 2,628,167, Mueller et al U.S. Pat. No. 2,950,972 Sidebotham U.S. Pat. No. 3,488,709, Rosecrants et al U.S. Pat. No. 3,737,313, Berry et al U.S. Pat. No. 3,772,031, Atwell U.S. Pat. No. 4,269,927, and *Research Disclosure,* Vol. 134, June 1975, Item 13452. *Research Disclosure* and its predecessor, Product Licensing Index, are publications of Industrial Opportunities Ltd.; Homewell, Havant; Hampshire, P09 1EF, United Kingdom. The tabular grain emulsions can be internally reduction sensitized during precipitation, as illustrated by Moisar et al, *Journal of Photographic Science,* Vol. 25 1977, pp. 19–27.

The individual silver and halide salts can be added to the reaction vessel through surface or subsurface delivery tubes by gravity feed or by delivery apparatus for maintaining control of the rate of delivery and the pH, pBr, and/or pAg of the reaction vessel contents, as illustrated by Culhane et al U.S. Pat. No. 3,821,002, Oliver U.S. Pat. No. 3,031,304 and Claes et al, *Photographische Korrespondenz,* Band 102, Number 10, 1967, p. 162. In order to obtain rapid distribution of the reactants within the reaction vessel, specially constructed mixing devices can be employed, as illustrated by Audran U.S. Pat. No. 2,996,287, McCrossen et al U.S. Pat. No. 3,342,605, Frame et al U.S. Pat. No. 3,415,650, Porter et al U.S. Pat. No. 3,785,777, Finnicum et al U.S. Pat. No. 4,147,551, Verhille et al U.S. Pat. No. 4,171,224, Calamur U.K. Patent Application No. 2,022,431A, Saito et al German OLS Nos. 2,555,364 and 2,556,885, and *Research Disclosure,* Volume 166, February 1978, Item 16662.

Once the high aspect ratio tabular grain emulsions have been formed by the process of the present invention they can be shelled to produce a core-shell emulsion by procedures well known to those skilled in the art. Any photographically useful silver salt can be employed in forming shells on the high aspect ratio tabular grain emulsions prepared by the present process. Techniques for forming silver salt shells are illustrated by Berriman U.S. Pat. No. 3,367,778, Porter et al U.S. Pat. Nos. 3,206,313 and 3,317,322, Morgan U.S. Pat. No. 3,917,485, and Maternaghan, cited above. Since conventional techniques for shelling do not favor the formation of high aspect ratio tabular grains, as shell growth proceeds the average aspect ratio of the emulsion declines. If conditions favorable for tabular grain formation are present in the reaction vessel during shell formation, shell growth can occur preferentially on the outer edges of the grains so that aspect ratio need not decline. Evans, Daubendiek, and Raleigh U.S. Ser. No. 431,912, filed concurrently herewith and commonly assigned, titled Direct Reversal Emulsions and Photographic Elements Useful in Image Transfer Film Units, which is a continuation-in-part of U.S. Ser. No. 320,891, filed Nov. 12, 1981, now abandoned, both of which are here incorporated by reference, specifically discloses the preparation of high aspect ratio core-shell tabular grain emulsions for use in forming direct reversal images.

In forming the tabular grain emulsions peptizer concentrations of from 0.2 to about 10 percent by weight, based on the total weight of emulsion components in the reaction vessel, can be employed. It is common practice to maintain the concentration of the peptizer in the reaction vessel in the range of below about 6 percent, based on the total weight, prior to and during silver halide formation and to adjust the emulsion vehicle concentration upwardly for optimum coating characteristics by delayed, supplemental vehicle additions. It is contemplated that the emulsion as initially formed will contain from about 5 to 50 grams of peptizer per mole of silver halide, preferably about 10 to 30 grams of peptizer per mole of silver halide. Additional vehicle can be added later to bring the concentration up to as high as 1000 grams per mole of silver halide. Preferably the concentration of vehicle in the finished emulsion is above 50 grams per mole of silver halide. When coated and dried in forming a photographic element the vehicle preferably forms about 30 to 70 percent by weight of the emulsion layer.

Vehicles (which include both binders and peptizers) can be chosen from among those conventionally employed in silver halide emulsions. Preferred peptizers are hydrophilic colloids, which can be employed alone or in combination with hydrophobic materials. Suitable hydrophilic materials include substances such as proteins, protein derivatives, cellulose derivatives—e.g., cellulose esters, gelatin—e.g., alkali-treated gelatin (cattle bone or hide gelatin) or acid-treated gelatin (pigskin gelatin), gelatin derivatives—e.g., acetylated gelatin, phthalated gelatin and the like, polysaccharides such as dextran, gum arabic, zein, casein, pectin, collagen derivatives, agar-agar, arrowroot, albumin and the like as described in Yutzy et al U.S. Pat. Nos. 2,614,928 and '929, Lowe et al U.S. Pat. Nos. 2,691,582, 2,614,930, '931, 2,327,808 and 2,448,534, Gates et al U.S. Pat. Nos. 2,787,545 and 2,956,880, Himmelmann et al U.S. Pat. No. 3,061,436, Farrell et al U.S. Pat. No. 2,816,027, Ryan U.S. Pat. Nos. 3,132,945, 3,138,461 and 3,186,846, Dersch et al U.K. Pat. No. 1,167,159 and U.S. Pat. Nos. 2,960,405 and 3,436,220, Geary U.S. Pat. No. 3,486,896, Gazzard U.K. Pat. No. 793,549, Gates et al U.S. Pat. Nos. 2,992,213, 3,157,506, 3,184,312 and 3,539,353, Miller et al U.S. Pat. No. 3,227,571, Boyer et al U.S. Pat. No. 3,532,502, Malan U.S. Pat. No. 3,551,151, Lohmer et al U.S. Pat. No. 4,018,609, Luciani et al U.K. Pat. No. 1,186,790, Hori et al U.K. Pat. No. 1,489,080 and Belgian Pat. No. 856,631, U.K. Pat. No. 1,490,644, U.K. Pat. No. 1,483,551, Arase et al U.K. Pat. No. 1,459,906, Salo U.S. Pat. Nos. 2,110,491 and 2,311,086, Fallesen U.S. Pat. No. 2,343,650, Yutzy U.S. Pat. No. 2,322,085, Lowe U.S. Pat. No. 2,563,791. Talbot et al U.S. Pat. No. 2,725,293, Hilborn U.S. Pat. No. 2,748,022, DePauw et al U.S. Pat. No. 2,956,883, Ritchie U.K. Pat. No. 2,095, DeStubner U.S. Pat. No. 1,752,069, Sheppard et al U.S. Pat. No. 2,127,573, Lierg U.S. Pat. No. 2,256,720, Gaspar U.S. Pat. No. 2,361,936, Farmer U.K. Pat. No. 15,727, Stevens U.K. Pat. No. 1,062,116 and Yamamoto et al U.S. Pat. No. 3,923,517.

Other materials commonly employed in combination with hydrophilic colloid peptizers as vehicles (including vehicle extenders—e.g., materials in the form of latices) include synthetic polymeric peptizers, carriers and/or binders such as poly(vinyl lactams), acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridine, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, polyalkyleneimine copolymers, polyamines, N,N-dialkylaminoalkyl acrylates, vinyl imidazole copolymers, vinyl sulfide copolymers, halogenated styrene polymers, amineacrylamide polymers, polypeptides and the like as described in Hollister et al U.S. Pat. Nos. 3,679,425, 3,706,564 and 3,813,251, Lowe U.S. Pat. Nos. 2,253,078, 2,276,322, '323, 2,281,703, 2,311,058 and 2,414,207, Lowe et al U.S. Pat. Nos. 2,484,456, 2,541,474 and 2,632,704, Perry et al U.S. Pat. No. 3,425,836, Smith et al U.S. Pat. Nos. 3,415,653 and 3,615,624, Smith U.S. Pat. No. 3,488,708, Whiteley et al U.S. Pat. Nos. 3,392,025 and 3,511,818, Fitzgerald U.S. Pat. Nos. 3,681,079, 3,721,565, 3,852,073, 3,861,918 and 3,925,083, Fitzgerald et al U.S. Pat. No. 3,879,205, Nottorf U.S. Pat. No. 3,142,568, Houck et al U.S. Pat. Nos. 3,062,674 and 3,220,844, Dann et al U.S. Pat. No. 2,882,161, Schupp U.S. Pat. No. 2,579,016, Weaver U.S. Pat. No. 2,829,053, Alles et al U.S. Pat. No. 2,698,240, Priest et al U.S. Pat. No. 3,003,879, Merrill et al U.S. Pat. No. 3,419,397, Stonham U.S. Pat. No. 3,284,207, Lohmer et al U.S. Pat. No. 3,167,430, Williams U.S. Pat. No. 2,957,767, Dawson et al U.S. Pat. No. 2,893,867, Smith et al U.S. Pat. Nos. 2,860,986 and 2,904,539, Ponticello et al U.S. Pat. Nos. 3,929,482 and 3,860,428, Ponticello U.S. Pat. No. 3,939,130, Dykstra U.S. Pat. No. 3,411,911 and Dykstra et al Canadian Pat. No. 774,054, Ream et al U.S. Pat. No. 3,287,289, Smith U.K. Pat. No. 1,466,600. Stevens U.K. Pat. No. 1,062,116, Fordyce U.S. Pat. No. 2,211,323, Martinez U.S. Pat. No. 2,284,877, Watkins U.S. Pat. No. 2,420,455, Jones U.S. Pat. No. 2,533,166, Bolton U.S. Pat. No. 2,495,918, Graves U.S. Pat. No. 2,289,775, Yackel U.S. Pat. No. 2,565,418, Unruh et al U.S. Pat. Nos. 2,865,893 and 2,875,059, Rees et al U.S. Pat. No. 3,536,491, Broadhead et al U.K. Pat. No. 1,348,815, Taylor et al U.S. Pat. No. 3,479,186, Merrill et al U.S. Pat. No. 3,520,857, Bacon et al U.S. Pat. No. 3,690,888, Bowman U.S. Pat. No. 3,748,143, Dickinson et al U.K. Pat. Nos. 808,227 and '228, Wood U.K. Pat. No. 822,192 and Iguchi et al U.K. Pat. No. 1,398,055. These additional materials need not be present in the reaction vessel during silver halide precipitation, but rather are conventionally added to the emulsion prior to coating. The vehicle materials, including particularly to hydrophilic colloids, as well as the hydrophobic materials useful in combination therewith can be employed not only in the emulsion layers of the photographic elements of this invention, but also in other layers, such as overcoat layers, interlayers and layers positioned beneath the emulsion layers.

It is specifically contemplated that grain ripening can occur during the preparation of silver halide emulsions according to the present invention, and it is preferred that grain ripening occur within the reaction vessel during at least silver bromoiodide grain formation. Known silver halide solvents are useful in promoting ripening. For example, an excess of bromide ions, when present in the reaction vessel, is known to promote ripening. It is therefore apparent that the bromide salt solution run into the reaction vessel can itself promote ripening. Other ripening agents can also be employed and can be entirely contained within the dispersing medium in the reaction vessel before silver and halide salt addition, or they can be introduced into the reaction vessel along with one or more of the halide salt, silver salt, or peptizer. In still another variant the ripening agent can be introduced independently during halide and silver salt additions. Although ammonia is a known ripening agent, it is not a preferred ripening agent for the silver bromoiodide emulsions of this invention exhibiting the highest realized speed-granularity relationships. The preferred emulsions of the present invention are non-ammoniacal or neutral emulsions.

Among preferred ripening agents are those containing sulfur. Thiocyanate salts can be used, such as alkali metal, most commonly sodium and potassium, and ammonium thiocyanate salts. While any conventional quantity of the thiocyanate salts can be introduced, preferred concentrations are generally from about 0.1 to 20 grams of thiocyanate salt per mole of silver halide. Illustrative prior teachings of employing thiocyanate ripening agents are found in Nietz et al, U.S. Pat. No. 2,222,264, cited above; Lowe et al U.S. Pat. No. 2,448,534 and Illingsworth U.S. Pat. No. 3,320,069; the disclosures of which are here incorporated by reference. Alternatively, conventional thioether ripening agents, such as those disclosed in McBride U.S. Pat. No. 3,271,157, Jones U.S. Pat. No. 3,574,628, and Rosecrants et al U.S. Pat. No. 3,737,313, here incorporated by reference, can be employed.

The tabular grain high aspect ratio emulsions of the present invention are preferably washed to remove soluble salts. The soluble salts can be removed by decantation, filtration, and/or chill setting and leaching, as illustrated by Craft U.S. Pat. No. 2,316,845 and McFall et al U.S. Pat. No. 3,396,027; by coagulation washing, as illustrated by Hewitson et al U.S. Pat. No. 2,618,556, Yutzy et al U.S. Pat. No. 2,614,928, Yackel U.S. Pat. No. 2,565,418, Hart et al U.S. Pat. No. 3,241,969, Waller et al U.S. Pat. No. 2,489,341, Klinger, U.K. Pat. No. 1,305,409 and Dersch et al U.K. Pat. No. 1,167,159; by centrifugation and decantation of a coagulated emulsion, as illustrated by Murray U.S. Pat. No. 2,463,794, Ujihara et al U.S. Pat. No. 3,707,378, Audran U.S. Pat. No. 2,996,287 and Timson U.S. Pat. No. 3,498,454; by employing hydrocyclones alone or in combination with centrifuges, as illustrated by U.K. Pat. No. 1,336,692, Claes U.K. Pat. No. 1,356,573 and Ushomirskii et al *Soviet Chemical Industry,* Vol. 6, No. 3, 1974, pp. 181–185; by diafiltration with a semipermeable membrane, as illustrated by *Research Disclosure,* Vol. 102, October 1972, Item 10208, Hagemaier et al *Research Disclosure,* Vol. 131, March 1975, Item 13122, Bonnet *Research Disclosure,* Vol. 135, July 1975, Item 13577, Berg et al German OLS No. 2,436,461, Bolton U.S. Pat. No. 2,495,918, and Mignot U.S. Pat. No. 4,334,012, cited above, or by employing an ion exchange resin, as illustrated by Maley U.S. Pat. No. 3,782,953 and Noble U.S. Pat. No. 2,827,428. The emulsions, with or without sensitizers, can be dried and stored prior to use as illustrated by *Research Disclosure,* Vol. 101, September 1972, Item 10152. In the present invention washing is particularly advantageous in terminating ripening of the tabular silver bromoiodide grains after the completion of precipitation to avoid increasing their thickness and reducing their aspect ratio.

Although the procedures for preparing tabular silver halide grains described above will produce high aspect ratio tabular grain emulsions in which the tabular grains satisfying the thickness and diameter criteria for aspect ratio account for at least 50 percent of the total projected area of the total silver halide grain population, it is recognized that advantages can be realized by increasing the proportion of such tabular grains present. Preferably at least 70 percent (optimally at least 90 percent) of the total projected area is provided by tabular silver halide grains meeting the thickness and diameter criteria. While minor amounts of nontabular grains are fully compatible with many photographic applications, to achieve the full advantages of tabular grains the proportion of tabular grains can be increased. Larger tabular silver halide grains can be mechanically separated from smaller, nontabular grains in a mixed population of grains using conventional separation techniques—e.g., by using a centrifuge or hydrocyclone. An illustrative teaching of hydrocyclone separation is provided by Audran et al U.S. Pat. No. 3,326,641.

In accordance with established practices within the art it is specifically contemplated to blend the high aspect ratio tabular grain emulsions prepared by the process of the present invention with each other or with conventional emulsions to satisfy specific emulsion requirements. For example, it is known to blend emulsions to adjust the characteristic curve of a photographic element to satisfy a predetermined aim. Blending can be employed to increase or decrease maximum densities realized on exposure and processing, to decrease or increase minimum density, and to adjust characteristic curve shape between its toe and shoulder. To accomplish this the emulsions of this invention can be blended with conventional silver halide emulsions, such as those described in *Research Disclosure,* Vol. 176, December 1978, Item 17643, Paragraph I. It is specifically contemplated to blend the emulsions as described in sub-paragraph F of Paragraph I. When a relatively fine grain silver chloride emulsion is blended with the emulsions of the present invention, particularly the silver bromoiodide emulsions, a further increase in the sensitivity—i.e., speed-granularity relationship—of the emulsion can result.

Once high aspect ratio tabular grain silver bromoiodide (including silver chlorobromoiodide) emulsions have been prepared by the process of the present invention, they can be further modified, coated, exposed, and processed following procedures well known to those skilled in the art. The emulsions prepared by the present process can be chemically sensitized, as described in *Research Disclosure,* Item 17643, cited above, Paragraph III, here incorporated by reference. The emulsions can be spectrally sensitized and/or desensitized, as described in Paragraph IV. It is specifically preferred to substantially optimally chemically and spectrally sensitize the emulsions prepared by the present process by the techniques disclosed in Kofron et al, cited above, both of which are here incorporated by reference.

The photographic emulsions can contain brighteners, antifoggants, stabilizers, scattering or absorbing materials, hardeners, coating aids, plasticizers, lubricants, and matting agents, as described in Item 17643, Paragraphs V, VI, VII, X, XI, XII, and XVI. Methods of addition and coating and drying procedures can be employed, as described in Paragraphs XIV and XV. Conventional photographic supports can be employed, as described in Paragraph XVII. The photographic elements produced can be black-and-white or, preferably, color photographic elements which form silver images and/or dye images through the selective destruction, formation, or physical removal of dyes, as described in Paragraph VII. Specifically preferred color photographic elements according to this invention are those which form dye images through the use of color developing agents and dye-forming couplers. To put the photographic elements to use, they can be conventionally exposed, as described in Paragraph XVIII, and they can be conventionally processed, as described in Paragraph XIX.

EXAMPLES

The invention can be better appreciated by reference to the following specific examples.

In each of the examples the contents of the reaction vessel were stirred vigorously throughout silver and halide salt introductions; the term "percent" means percent by weight, unless otherwise indicated; and the term "M" stands for molar concentration, unless otherwise indicated. All solutions, unless otherwise indicated are aqueous solutions.

Emulsion 1—(Invention)

This illustrates the preparation of a high aspect ratio tabular grain silver bromoiodide emulsion according to the present invention employing silver iodide grains initially in the reaction vessel having an average diameter of approximately 0.025 micron with the concentration of the iodide initially in the reaction vessel prior to concurrent silver and bromide salt introduction being adjusted to $0.73\times10^{-3}$ mole per liter.

A. Preparation of AgI Seed Grains

To a 6.0 liter aqueous bone gelatin solution (1.3% gelatin, Solution A) maintained at pI 2.85 (adjusted with sodium iodide solution) and 35° C. were added with stirring by double-jet addition at an accelerated flow rate (3X from start to finish—i.e., 3 times faster at the end than at the start), aqueous solutions of silver nitrate (5.0 molar, Solution C) and sodium iodide (5.0 molar, Solution B), until Solution B was exhausted (approximately 3.5 minutes). Solution C was added slowly to adjust the emulsion to pI 4.8 for storage and later use. 0.5 Mole of silver was used to prepare this emulsion.

B. Preparation of AgBrI Tabular Grain Emulsion

A 3.3 liter aqueous bone gelatin solution (2.57% gelatin, Solution D) at 80° C., pH 6.0, pBr 1.06 (adjusted with 5 molar sodium bromide solution) and containing $2.44\times10^{-3}$ mole of the above-described AgI seed emulsion was prepared. To Solution D containing the AgI seed emulsion were added by double-jet addition at an accelerated flow rate (8.0X from start to finish) aqueous solutions of sodium bromide (4.0 molar, Solution E) and silver nitrate (4.0 molar, Solution F) while maintaining pBr 1.06 until Solution E was exhausted (approximately 21 minutes; 83.9% of the total silver consumed). Solution F was added slowly until pBr 2.98 at 80° C. was attained. The emulsion was cooled to 35° C. and stored. 3.33 Moles of silver in addition to the seed grains were used to prepare this emulsion.

FIG. 1 is a photograph (9,900X (magnification) of a carbon replica electron micrograph of the emulsion. The characteristics of the grains are quantitatively summarized below in Table I.

Emulsion 2—(A Control Emulsion)

This control illustrates the result of increasing the initial concentration of iodide in the reaction vessel from $0.73\times10^{-3}$ mole/liter as in Emulsion 1 to 0.05 mole/liter prior to concurrent silver and bromide salt introduction. The size of the silver iodide seed grains employed remained unchanged at approximately 0.025 micron average diameter.

A. The preparation of silver iodide seed grains was identical to the procedure described from Emulsion 1.

B. Preparation of AgBrI Emulsion

A 3.3 liter aqueous bone gelatin solution (2.57% gelatin, Solution A) at 80° C., pH 6.0, pBr 1.06 (adjusted with 5 M sodium bromide solution) and containing $1.65\times10^{-1}$ mole of the above-described seed emulsion was prepared. To Solution A containing the silver iodide seed emulsion were added by double-jet addition at an accelerated flow rate (8.0X from start to finish) aqueous solutions of sodium bromide (4.0 molar, Solution B) and silver nitrate (4.0 molar, Solution C) while maintaining pBr 1.30 until Solution B was exhausted (approximately 21 minutes; 83.9% of the total silver consumed). Solution C was added slowly until pBr 2.98 at 80° C. was attained. The emulsion was cooled to 35° C.

and stored. 3.33 Moles of silver in addition to the seed grains were used to prepare this emulsion.

Figure 2:
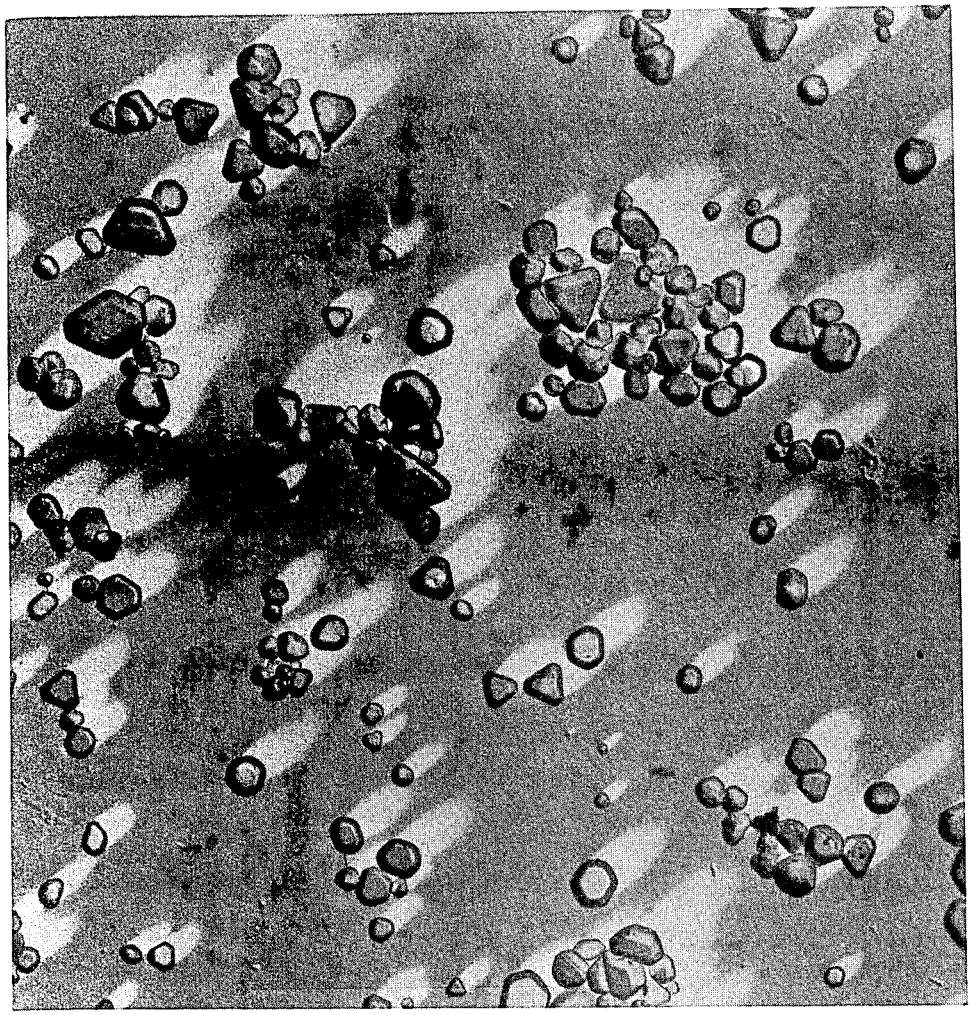

FIG. 2 is a photograph (9,900X magnification) of a carbon replica electron micrograph of the AgBrI emulsion prepared. The characteristics of the grains are quantitatively summarized below in Table I.

Emulsion 3—(Invention)

This illustrates the preparation of a high aspect ratio tabular grain silver bromoiodide emulsion according to the present invention employing silver iodide grains initially in the reaction vessel having an average diameter of approximately 0.061 micron (as opposed to 0.025 micron used in preparing Emulsion 1). As in the preparation of Emulsion 1, the concentration of the iodide initially present in the reaction vessel prior to concurrent silver and bromide salt introduction was adjusted to $0.73\times10^{-3}$ mole per liter.

A. Preparation of AgI Seed Grains

To a 3.0 liter aqueous bone gelatin solution (2.67% gelatin, Solution A) at pI 2.85, containing 0.05 mole AgI seeds prepared in Step A, Emulsion 1 and at 35° C. were added by double-jet addition at an accelerated flow rate (3.5X from start to finish), aqueous solutions of sodium iodide (5.0 molar, Solution B) and silver nitride (5.0 molar, Solution C) over a 12-min period (until Solution B was exhausted). The emulsion was adjusted to pI 4.95 by carefully adding Solution C and stored for use in preparing the following emulsion. 0.45 Moles of silver in addition to the seed grains were used to prepare the emulsion.

B. Preparation of AgBrI Tabular Grain Emulsion

A 3.3 liter aqueous bone gelatin solution (2.57% gelatin, Solution D) at 80° C., pH 6.0, pBr 1.06 (adjusted with 5 molar sodium bromide solution) and containing $2.4\times10^{-3}$ mole AgI seeds from Step A was prepared. To Solution A containing the silver iodide seed grains were added, by double-jet addition at an accelerated flow rate (8.0X from start to finish), aqueous solutions of sodium bromide (4.0 molar, Solution E) and silver nitrate (4.0 molar, Solution F) while maintaining pBr 1.30 until Solution E was exhausted (approximately 21 min; 83.9% of the total silver consumed). Solution F was added slowly at a constant flow rate until pBr 2.94 at 80° C. was attained. The emulsion was cooled at 35° C. and stored. 3.33 Moles of silver in addition to the seed grains were used to prepare this emulsion.

Figure 3:
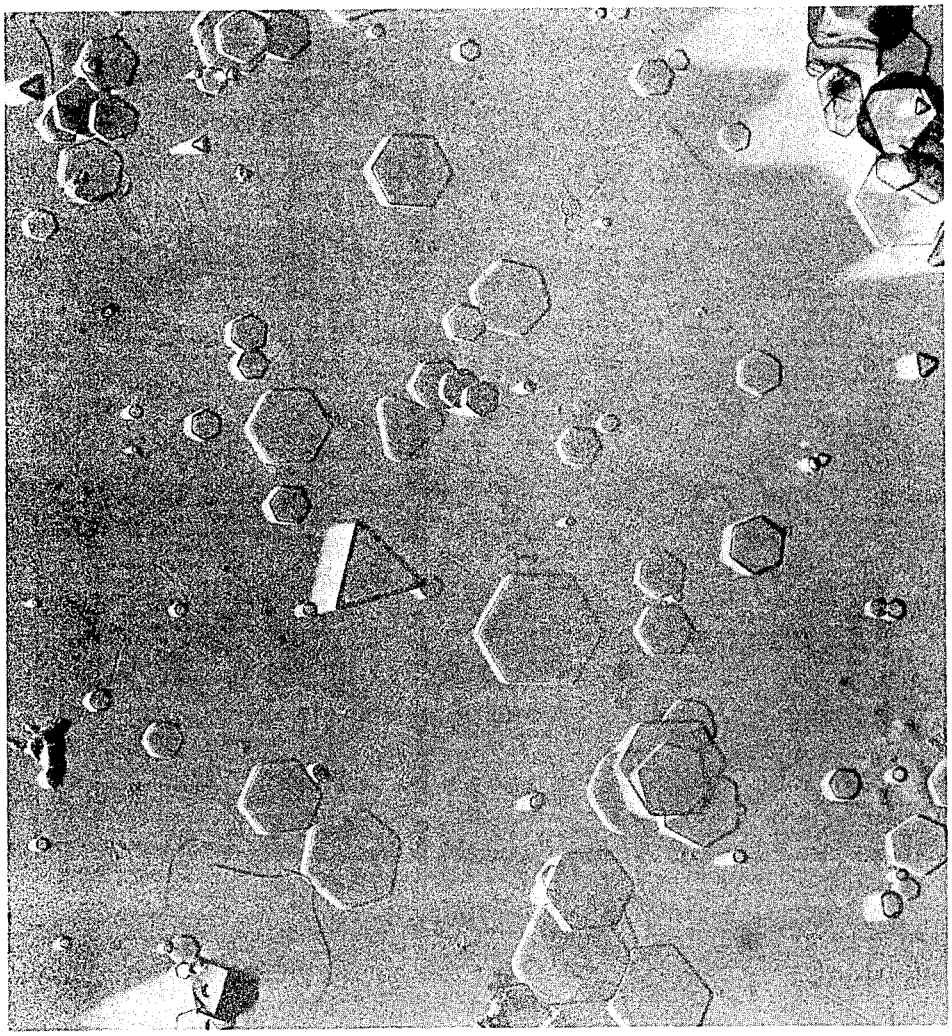

FIG. 3 is a photograph (9,900X magnification) of a carbon replica electron micrograph of the emulsion. The characteristics of the grains are quantitatively summarized below in Table I.

TABLE I

| Emulsion No. | Initial Iodide Content (mole per l) | Average Grain Diameter | Average Grain Thickness | Average Aspect Ratio* | Tabular Grain % of Projected Area* |
|---|---|---|---|---|---|
| 1 (Invention) | 0.00073 | 1.0 μm | ≃0.06 μm | 19.5:1 | 89% |
| 2 (Control) | 0.05 | 0.5 μm | ≃0.35 μm | 1.8:1 | — |
| 3 (Invention) | 0.00073 | 1.0 μm | ≃0.06 μm | 17.3:1 | 82% |

*Based on grains having a thickness of less than 0.3 micron and a diameter of at least 0.6 micron.

As illustrated in FIGS. 1-3 and Table I, tabular grain AgBrI emulsions which contain a high percentage of high aspect ratio grains can be prepared by the practice of this invention. Emulsions 1 and 3, which were prepared with less than 0.01 mole/liter of silver iodide in the reaction vessel, were high aspect ratio tabular AgBrI emulsions. However, Emulsion 2, which was prepared with 0.05 mole/liter of silver iodide as taught in the published art, was a low aspect ratio (1.8:1) AgBrI emulsion.

The following examples illustrate the incorporation of various molar concentrations of iodide into the crystal structure. The iodide is added via triple-jet addition at identified stages of the precipitation process.

Emulsion 4

A 5.0 liter aqueous bone gelatin solution (0.94% gelatin, Solution A) at 80° C., pH 6.0, pBr 1.28 (adjusted with 5 molar sodium bromide solution) and containing $2.44\times10^{-4}$ mole AgI seed grains from Emulsion 1, Step A was prepared. To Solution A containing the silver iodide seed grains were added by double-jet addition at a constant flow rate, aqueous solutions of sodium bromide (1.25 molar, Solution B) and silver nitrate (1.25 molar, Solution C) at pBr 1.28 and 80° C. until Solutions B and C were exhaustd (approximately 1 min, 0.11% of the total silver consumed).

Aqueous solutions of sodium bromide (2.5 molar, Solution D) and silver nitrate (2.5 molar, Solution E) were added next to pBr 1.50 and 80° C. utilizing an accelerated flow rate (30.6X from start to finish) until Solution D was exhausted (approximately 24.5 min, 86.6% of total silver consumed).

Solution E was added slowly at a constant flow rate at 80° C. until pBr 2.96 was attained (13.3% of the total silver consumed). The emulsion was cooled to 35° C. and adjusted to pBr 2.98 with additional 2.5 molar sodium bromide solution and stored. 4.0 Moles of silver were used to prepare this emulsion.

The resultant tabular grain AgBrI (0.006 mole percent iodide content contributed by AgI seed grains) emulsion had an average grain diameter of about 2.8 μm and an average grain thickness of 0.08 μm. The grains having a thickness of less than 0.3 micron and a diameter of at least 0.6 micron exhibited an average aspect ratio of about 35:1 and accounted for greater than 80 percent of the projected area.

Emulsion 5

A 5.0 liter aqueous bone gelatin solution (0.94% gelatin, Solution A) at 80° C., pH 6.0, pBr 1.28 (adjusted by adding 5 molar sodium bromide solution) and containing $2.44\times10^{-4}$ mole AgI seed grains from Emulsion 1, Step A was prepared. To Solution A containing the silver iodide seed grains were added by double-jet addition at a constant flow rate, aqueous solutions of sodium bromide (1.25 molar, Solution B) and silver nitrate (1.25 molar, Solution C) at pBr 1.28 and 80° C. for approximately 1 min (approximately 0.1% of the total silver consumed). After the initial 1-min addition period, a 5 molar aqueous sodium bromide solution was added in order to adjust to pBr 1.08. Solutions B and C were continued at an accelerated flow rate (2.3X from start to finish) for an additional 1 min at pBr 1.08 and 80° C. by double-jet addition (approximately 0.1% of the total silver consumed). Flow of Solution B and Solution C was was halted and flow of Solution E (2.5 molar, $AgNO_3$) was begun until pBr 1.28 at 80° C. was attained.

3.6% of total silver consumed was used to complete this step.

Aqueous solutions of sodium bromide (2.5 molar, Solution D) and silver nitrate (2.5 molar, Solution E) were added next by double-jet addition at an accelerated flow rate (14.3X from start to finish) at pBr 1.28 and 80° C. until Solution D was exhausted (approximately 19.5 min; approximately 64% of total silver consumed).

Aqueous solutions of sodium bromide (2.5 molar, Solution F), sodium iodide (0.95 molar, Solution G) and Solution E were added next by triple-jet addition at constant flow rate until Solution F was depleted (approximately 3.0 min, 19.5% of total silver consumed). Solution G was halted.

Solutions E and G were added at constant flow rate until pBr 2.98 at 80° C. was attained. The emulsion was cooled to 35° C. stored. 4.12 Moles of silver were used to prepare this emulsion.

The resultant tabular grain AgBrI (3.006 mole percent iodide) emulsion had an average grain diameter of about 2.9 μm and an average grain thickness of 0.08 μm. The grains having a thickness of less than 0.3 micron and a diameter of a least 0.6 micron exhibited an average aspect ratio of 36:1 and accounted for greater than 80 percent of the projected area. Apart from the silver iodide seed grains, bromide was the sole halide introduced during the first 70% of precipitation. Thereafter bromide and iodide were introduced in an 90:10 molar ratio.

Emulsion 6

A 10.0 liter aqueous bone gelatin solution (0.94% gelatin, Solution A) at 80° C., pH 6.0, pBr 1.28 (adjusted by adding 5 molar aqueous sodium bromide solution) and containing $4.88\times10^{-4}$ mole of AgI seed grains from Emulsion 1, Step A was prepared. To Solution A at pBr 1.28 and 80° C. were added for 1 min (0.23% of total silver consumed) by double-jet addition at constant flow rate, aqueous solutions of sodium bromide (1.25 molar, Solution B) and silver nitrate (1.25 molar, Solution C). Solutions B and C were halted.

Aqueous solutions of sodium bromide (2.5 molar, Solution D) and silver nitrate (2.5 molar, Solution E) were added next at pBr 1.28 and 80° C. by double-jet addition for approximately 9.5 min (approximately 27% of total silver consumed) at an accelerated flow rate (13.2X from start to finish).

Aqueous solutions of sodium bromide (2.5 molar, Solution F) and Solution E were added next by double-jet addition at pBr 1.28, 80° C. and at an accelerated flow rate (2.2X from start to finish) until Solution F was depleted (12 min, approximately 55% of total silver consumed). Simultaneously, a third jet was used to add an aqueous solution of sodium iodide (1.15 molar, Solution G) at the same accelerated flow rate profile (2.2X from start to finish) except that Solution G was added at 26% of the flow rate of Solutions E and F.

Solutions E and G were added next by double-jet addition at a constant flow rate (Solution G at 26% of the flow rate of Solution E) until pBr 2.98 at 80° C. was attained (approximately 26 min; approximately 18% of total silver consumed).

Finally, the emulsion was cooled to 35° C. and coagulation washed by the method of Yutzy and Russell U.S. Pat. No. 2,614,929. 4.0 Moles of silver were used to prepare this emulsion.

The resultant tabular grain AgBrI (≃8.5 mole percent iodide) emulsion had an average grain diameter of 2.0 μm, an average grain thickness of 0.08 μm, and an aspect ratio of ≃25:1. Greater than 80 percent of the grains were tubular based on projected area. Apart from the silver iodide seed grains, bromide was the sole halide introduced during the first 30% of precipitation. Thereafter bromide and iodide were introduced in an 88:12 molar ratio.

Emulsion 7

I. Preparation of tabular grain AgBrI core emulsion. Average grain diameter=≃1.3 μm, average grain thickness=0.06 μm.

A 10.0 liter aqueous bone gelatin solution (0.94% gelatin, Solution A) at pH 6.0, 80° C., pBr 1.28 (adjusted by adding 5 M sodium bromide solution) and containing $4.88\times10^{-4}$ mole of AgI seed grains from Emulsion 1, Step A was prepared. To Solution A maintained at pBr 1.28 and 80° C. were added for 1 min (0.23% of total silver consumed) by double-jet addition at constant flow rate, aqueous solutions of sodium bromide (1.25 molar, Solution B) and silver nitrate (1.25 molar, Solution C).

Aqueous solutions of sodium bromide (2.5 molar, Solution D) and silver nitrate (2.5 molar, Solution E) were added next by double-jet addition at pBr 1.28, 80° C., and an accelerated flow rate (15.8X from start to finish) until Solution D was depleted (approximately 10 min; approximately 67% of total silver consumed).

Finally, Solution E was added slowly at constant flow rate (approximately 16.3 min; approximately 32.8% of total silver consumed) until pBr 2.98 at 80° C. was reached. The emulsion was cooled at 35° C. and stored. 2.0 Moles of silver in addition to the seed grains were used to prepare this emulsion.

II. Preparation of Final Tabular Grain AgBrI Emulsion

A 5.0 liter aqueous bone gelatin solution (0.72% gelatin, Solution A) at pH 6.0, 80° C., pBr 1.28 (adjusted by adding 5 molar aqueous sodium bromide solution) and containing 0.10 mole of the emulsion of Step I was prepared. To Solution A maintained at 80° C. and pBr 1.28 were added by double-jet addition at an accelerated flow rate (25.4X from start to finish) over approximately 75 min (Solution B exhausted; 87.5% of the total silver consumed), aqueous solutions of sodium bromide (2.5 molar, Solution B) and silver nitrate (2.5 molar, Solution C). Simultaneously, an aqueous solution of sodium iodide (0.96 molar, Solution D) was added by a third jet at the same accelerated rate profile (25.4X from start to finish) except that Solution D was added at 31% of the flow rate of Solution C.

After Solution B was depleted, Solution C was continued at constant flow rate for approximately 30 min until pBr 2.98 at 80° C. was attained (approximately 12.5% of total silver consumed). Finally, the emulsion was cooled to 35° C. and stored. 3.9 Moles of silver in addition to the emulsion from Step I were used to prepare this emulsion.

The resultant tabular grain AgBrI (approximately 10.2 mole percent iodide) emulsion had an average grain diameter of 5.0 μm and an average grain thickness of 0.12 μm. The grains having a thickness of less than 0.3 micron and a diameter of at least 0.6 micron exhibited an average aspect ratio of ≃42:1 and accounted for greater than 80 percent of the projected area. Apart from the silver iodide seed grains, bromide was the sole halide introduced during the first 2.5% of precipitation. Thereafter bromide and iodide were introduced in an 88:12 molar ratio until 85.3% of the silver halide was precipitated. During the last 12.2% of precipitation only bromide was introduced.

Emulsion 8

A 10.0 liter aqueous bone gelatin solution (0.94% gelatin, Solution A) at pH 6.0 and 80° C., adjusted to pBr 1.35 by adding a 5 molar sodium bromide solution and containing $9.76\times10^{-4}$ mole AgI seed grains from Emulsion 1, Step A was prepared. To Solution A maintained at pBr 1.35 and 80° C. were added by double-jet addition at constant flow rate for 0.80 min (0.18% of total silver consumed), aqueous solutions of sodium bromide (0.625 molar, Solution B) and silver nitrate (0.625 molar, Solution C).

A 5.0 molar sodium bromide solution was added carefully to obtain pBr 1.08 at 80° C. The emulsion was held with stirring for 2 min.

Solution C was added next at an accelerated flow rate (53.3X from start to finish) for approximately 17.5 min (approximately 10% of total silver consumed) until pBr 1.27 at 80° C. was attained. Simultaneously, an aqueous solution of sodium iodide (0.245 molar, Solution F) was added at the same accelerated flow rate profile except that Solution F was added at 31% of the flow rate of Solution C.

Solutions B and C were added next by double-jet addition at an accelerated rate (1.8X from start to finish) at pBr 1.27 and 80° C. for approximately 12.7 min (18.7% of total silver consumed). Simultaneously, Solution F was added at the same accelerated rate profile (1.8X) except that its rate was 31% of the flow rate of Solution C. Solution B was depleted.

Aqueous solutions of sodium bromide (2.5 molar, Solution D) and silver nitrate (2.5 molar, Solution E) were added next at pBr 1.27 and 80° C. by double-jet addition utilizing an accelerated flow rate (2.9X from start to finish) until Solution D was exhausted (approximately 15.8 min; approximately 45.7% of total silver consumed). Simultaneously, an aqueous solution of sodium iodide (0.98 molar, Solution G) was added at the same accelerated flow rate profile (2.9X) except that its flow rate was 31% of the flow rate of Solution E.

Solution E was added next at a constant flow rate until pBr 2.98 at 80° C. was reached (approximately 30 minutes, 25.4% of total silver used). Simultaneously, Solution G was added at 31% of the flow rate of Solution E. 4.0 Moles of silver were used to prepare this emulsion.

Finally, the emulsion was cooled to 35° C. and coagulation washed as described for Emulsion 6.

The resultant tabular grain AgBrI (about 12 mole percent iodide) emulsion of uniform iodide distribution had an average grain diameter of 2.0 μm and an average grain thickness of 0.10 μm. The grains having a thickness less than 0.3 micron and a diameter at least than 0.6 micron exhibit an average aspect ratio of ≃20:1 and account for greater than 80 percent of the projected area.

Emulsion 9

To a 2.0 liter aqueous bone gelatin solution (1.5 percent gelatin, Solution A) containing potassium bromide (pBr 1.12) and potassium iodide (pI 3.12) at 70° C. was added at constant flow rate a silver nitrate solution (1.25 molar, Solution C) until Solution A stabilized at pBr 1.12 (approximately 12 seconds; 0.19% of total silver consumed).

An aqueous solution of potassium bromide (1.25 molar, Solution B) and Solution C were added next by double-jet addition at pBr 1.12 and 70° C. utilizing an accelerated flow rate (8X from start to finish) until Solution C was depleted (approximately 36 minutes; 99.81% of total silver consumed). 2.0 Moles of silver were used to prepare this emulsion.

The initial iodide concentration of the reaction vessel was $1.50\times10^{-3}$ moles per liter. The iodide initially in the reaction vessel precipitated out upon silver salt introduction as silver iodide seed grains formed in situ. The tabular grain silver bromoiodide emulsion had an average grain diameter of 1.53 micron, an average thickness of 0.08 micron, and the tabular grains having a diameter of at least 0.6 micron and a thickness of less than 0.3 micron exhibited an average aspect ratio of 19:1 and accounted for greater than 90 percent of the total projected area of the silver bromoiodide grains present in the invention.

To illustrate the photographic utility of the emulsions prepared according to the present invention, Emulsion 6 was spectrally sensitized by the addition of 0.9 millimole anhydro-5-chloro-9-ethyl-5'-phenyl -3'-(3-sulfobutyl)-3-(3-sulfopropyl)-oxacarbocyanine hydroxide, sodium salt and 0.3 millimole anydro-11-ethyl-1,1'-bis(3-sulfopropyl)-naphth[1,2d]oxazolocarbocyanine hydroxide, sodium salt. Then the emulsion was chemically sensitized with 150 mg sodium thiocyanate/Ag mole, 7.5 mg sodium thiosulfate pentahydrate/Ag mole, 3.0 mg potassium tetrachloroaurate/Ag mole, and 20 mg 3-methyl benzothiazolium iodide/Ag mole.

The emulsion was coated on a polyester film support at 1.07 g/m$^2$ silver and 2.15 g/m$^2$ gelatin. The coating element also contained a solvent dispersion of the magenta image-forming coupler 1-(6-chloro-2,4-dimethylphenyl)-3-[α-(m-pentadecylphenoxy)butyramido]-5-pyrazolone at 0.75 g/m$^2$ coupler, the antistain agent 5-sec-octadecylhydroquinone-2-sulfonate, potassium salt at 3.2 g/Ag mole, and the antifoggant 4-hydroxy-6-methyl-1,3,3a,7-tetraazaindene at 3.4 g/Ag mole. The emulsion layer was overcoated with a 0.86 g/m$^2$ gelatin layer which contained 1.75% bis(vinylsulfonylmethyl)-ether hardener based on total gelatin weight.

The coating was exposed for 1/25 second to a 600 W 5500° K. tungsten light source through a 0–6 density step tablet (0.30 steps) and Wratten No. 12 filter and processed for 2¾ minutes at 37.7° C. in a color developer of the type described in the *British Journal of Photography Annual*, 1979, pages 204–206. Sensitometric results revealed a substantial negative dye image of good discrimination with a $D_{min}$ of 0.08 and a $D_{max}$ of 1.78.

Emulsion 10

The emulsion was prepared by a single stage continuous precipitation method as described in Terwilliger et al, U.S. Pat. No. 4,046,576, using a reaction vessel with means of agitation and of addition of reactants similar to that disclosed in Frame et al, U.S. Pat. No. 3,415,650. The reaction vessel was charged with 1.2 liters of a 2.25% by weight gelatin solution at 80° C., whose pBr was adjusted to a value of 1.64 by addition of a 2.50 molar solution of sodium bromide and potassium iodide containing 12 mole percent of iodide. The pBr was maintained at 1.64 and the temperature at 80° C. throughout the precipitation.

The following three solutions were then added simultaneously to the reaction vessel:

(A) 2.00 molar $AgNO_3$;

(B) 2.50 molar NaBr+KI (12 mole % KI);

(C) 2.25% gelatin solution.

Solution C was added at a rate of 229 cc/minute, Solutions A and B each at 57 cc/minute. The reaction vessel contents were withdrawn at 343 cc/minute, providing a residence time of 5 minutes. An emulsion sample was taken after 10 residence times, when steady state conditions had been reached.

The resulting AgBrI (12 mole % I) tabular grain emulsion had an average tabular grain size of 1.6 μm, an average tabular grain thickness of approximately 0.1 μm, an average aspect ratio of 16:1, and about 85% of the projected area was provided by tabular grains. Since grain nucleation and growth was taking place concurrently in the reaction vessel under steady state conditions, the grains ranged from high aspect ratio tabular grains to small grains of less than 0.1 micron in diameter.

The invention has been described in detail with particular reference to preferred embodiments thereof, but it will be understood that variations and modifications can be effected within the spirit and scope of the invention.

What is claimed is:

1. In a process for preparing a radiation-sensitive tabular grain silver bromoiodide emulsion wherein silver and bromide salts are concurrently introduced into a reaction vessel containing an emulsion comprising a dispersing medium and high iodide silver halide grains, the improvement comprising limiting in the reaction vessel prior to concurrent introduction of silver and bromide salts the mean diameter of the high iodide silver halide grains to less than 0.1 micron and the concentration of iodide to less than $10^{-2}$ mole per liter, thereby producing within the dispersing medium contained within the reaction vessel silver bromoiodide grains having a thickness of less than 0.3 micron and a diameter of at least 0.6 micron exhibiting an average aspect ratio of greater than 8:1 and accounting for at least 50 percent of the total projected area of said silver bromoiodide grains.

2. An improved process according to claim 1 wherein the mean diameter of the silver halide grains is less than 0.05 micron.

3. An improved process according to claim 1 wherein the dispersing medium is a peptizer.

4. An improved process according to claim 3 wherein the peptizer is gelatin or a gelatin derivative.

5. An improved process according to claim 1 wherein iodide salt is introduced into the reaction vessel along with silver and bromide salts.

6. An improved process according to claim 1 wherein chloride salt is introduced into the reaction vessel along with silver and bromide salts.

7. An improved process according to claim 1 wherein the high iodide silver halide grains consist of at least 90 mole percent iodide, based on silver.

8. An improved process according to claim 7 wherein the high iodide silver halide grains consist essentially of silver iodide.

9. In a process of preparing a radiation-sensitive tabular grain silver bromoiodide emulsion comprising (a) providing in a reaction vessel an emulsion comprising a peptizer and silver iodide grains and thereafter (b) concurrently introducing into the reaction vessel silver and bromide salts, the improvement comprising limiting in the reaction vessel prior to concurrent introduction of silver and bromide salts the mean diameter of the silver halide grains to less than 0.05 micron and the concentration of iodide to less than $10^{-2}$ mole per liter, thereby producing within the dispersing medium contained within the reaction vessel silver bromoiodide grains having a thickness of less than 0.3 micron and a diameter of at least 0.6 micron exhibiting an average aspect ratio of at least 12:1 and accounting for at least 70 percent of the total projected area of said silver bromoiodide grains.

10. An improved process according to claim 9 wherein iodide salt is introduced into the reaction vessel concurrently with the introduction of silver and bromide salt.

* * * * *

UNITED STATES PATENT AND TRADEMARK OFFICE

CERTIFICATE OF CORRECTION

PATENT NO. : 4,414,310

DATED : November 8, 1983

INVENTOR(S) : Richard L. Daubendiek and Ronald W. Strong

It is certified that error appears in the above-identified patent and that said Letters Patent are hereby corrected as shown below:

Title page, second column, under OTHER PUBLICATIONS, after line 10,

--Claes, "Crystal Growth and Reactivity Sites of Twinned-Tabular Grains", Photo. Korr., 101(9) (1965), pp. 139-144.

Claes et al, "Crystal Habit Modification of AgBr by Incorporation of I-Ions", Photo. Korr., 103(10) (1967), pp. 161-164.--

Signed and Sealed this

*Twenty-seventh* Day of *May 1986*

[SEAL]

*Attest:*

DONALD J. QUIGG

*Attesting Officer*

*Commissioner of Patents and Trademarks*